US009032846B2

(12) United States Patent
York et al.

(10) Patent No.: US 9,032,846 B2
(45) **Date of Patent: *May 19, 2015**

(54) MILLING TOOL HOLDER WRENCH

(71) Applicants: Bryan Scott York, Liberty Township, OH (US); David Sean York, Liberty Township, OH (US)

(72) Inventors: Bryan Scott York, Liberty Township, OH (US); David Sean York, Liberty Township, OH (US)

(73) Assignee: Scott York, Liberty Township ( * ) Notice: Subject to any disclaimer, the term of this patent is extended or adjusted under 35 U.S.C. 154(b) by 179 days.

This patent is subject to a terminal disclaimer.

(21) Appl. No.: 13/714,068

(22) Filed: Dec. 13, 2012

(65) Prior Publication Data

US 2014/0137708 A1 May 22, 2014

Related U.S. Application Data

(63) Continuation-in-part of application No. 13/679,805, filed on Nov. 16, 2012, now Pat. No. 8,925,427.

(51) Int. Cl.
*B25B 13/02* (2006.01)
*B25B 13/50* (2006.01)

(52) U.S. Cl.
CPC ..... *B25B 13/02* (2013.01); *B25B 13/50* (2013.01)

(58) Field of Classification Search
USPC ..... 81/176.1, 176.2, 176.15; 29/243; 409/234
See application file for complete search history.

(56) References Cited

U.S. PATENT DOCUMENTS

| | | | | |
|---|---|---|---|---|
| 1,882,462 | A * | 10/1932 | Weber | 81/176.2 |
| 3,977,063 | A * | 8/1976 | Bruninga | 29/890.143 |
| 6,131,494 | A * | 10/2000 | Quenneville | 81/125.1 |
| 6,792,834 | B2 * | 9/2004 | Eriksson | 81/176.2 |
| 7,107,880 | B2 * | 9/2006 | Kitchen et al. | 81/176.1 |
| 8,348,560 | B1 * | 1/2013 | Furman et al. | 409/138 |
| 2004/0009047 | A1 * | 1/2004 | Neumeier | 409/232 |
| 2006/0073776 | A1 * | 4/2006 | Gallup | 451/353 |

* cited by examiner

*Primary Examiner* — David B Thomas
(74) *Attorney, Agent, or Firm* — Schweman Lundberg & Woessner, P.A.

(57) ABSTRACT

A milling tool holder wrench is provided. A wrench includes two knobs that protrude outward and perpendicular from a surface of the wrench at a top end of a u-shaped portion of the wrench. The knobs adapted to snuggly engage recessed fittings of a milling tool holder to lock the milling tool holder steady within a milling machine while a tool is changed from the milling tool holder.

20 Claims, 7 Drawing Sheets

MILLING TOOL HOLDER WRENCH

RELATED APPLICATIONS

The present application is co-pending with, claims priority to, and is a Continuation-In Part (CIP) of U.S. application Ser. No. 13/679,805 entitled "Cat 40 Tool Holder Wrench," filed on Nov. 16, 2012, the disclosure of which is incorporated by reference in its entirety herein and below.

BACKGROUND

A milling machine is a machine tool used to machine solid materials. Unlike a drill press that holds a work piece stationary as the drill moves axially to penetrate the material, milling machines also move the work piece radially against the rotating milling cutter (milling tool), which cuts on its sides as well as its tip. Work piece and cutter movement are precisely controlled to less than 0.001 in (0.025 mm), usually by means of precision ground slides and screws, and the like. Milling machines may be manually operated, mechanically automated, and/or digitally automated via computer numerical control.

Milling machines can perform a vast number of operations, from simple (e.g., slot and keyway cutting, planing, drilling) to complex (e.g., contouring, die sinking).

Milling machines include multiple holders that are used to hold the milling cutters or tools. These tools can be changed out when different tools are needed, such as when replacements for defective tools and/or when different types of tools are needed from what originally existed in the holders.

Changing out milling tools is a time consuming process because conventionally, the holders are first removed from the milling machine and then placed in other devices to steady the holders while the tools are swapped out of the holders for other tools. Then, the holders with the other tools are placed back in the milling machine.

This entails no less than four steps: 1) removing the tool holder; 2) removing the existing tool from the tool holder; 3) inserting a replacement tool into the tool holder; and 4) re-inserting the tool holder into the milling machine.

One positive aspect of the process is that the milling machine tool holders are for the most part standardized to a particular standard, referred to as cat 30-40.

SUMMARY

In various embodiments, a milling tool holder wrench is presented.

The milling tool holder wrench includes two protruding knobs each located along a top and opened end of a u-shaped portion of the wrench. Each knob extending upward and perpendicular to a surface of the wrench. The u-shaped portion including a handle portion extending from a closed end of the u-shaped portion. Moreover, the knobs are adapted to fit into a milling tool holder for changing a tool out of the milling tool holder while the milling tool holder remains in a milling machine.

DETAILED DESCRIPTION

Figure 1A:
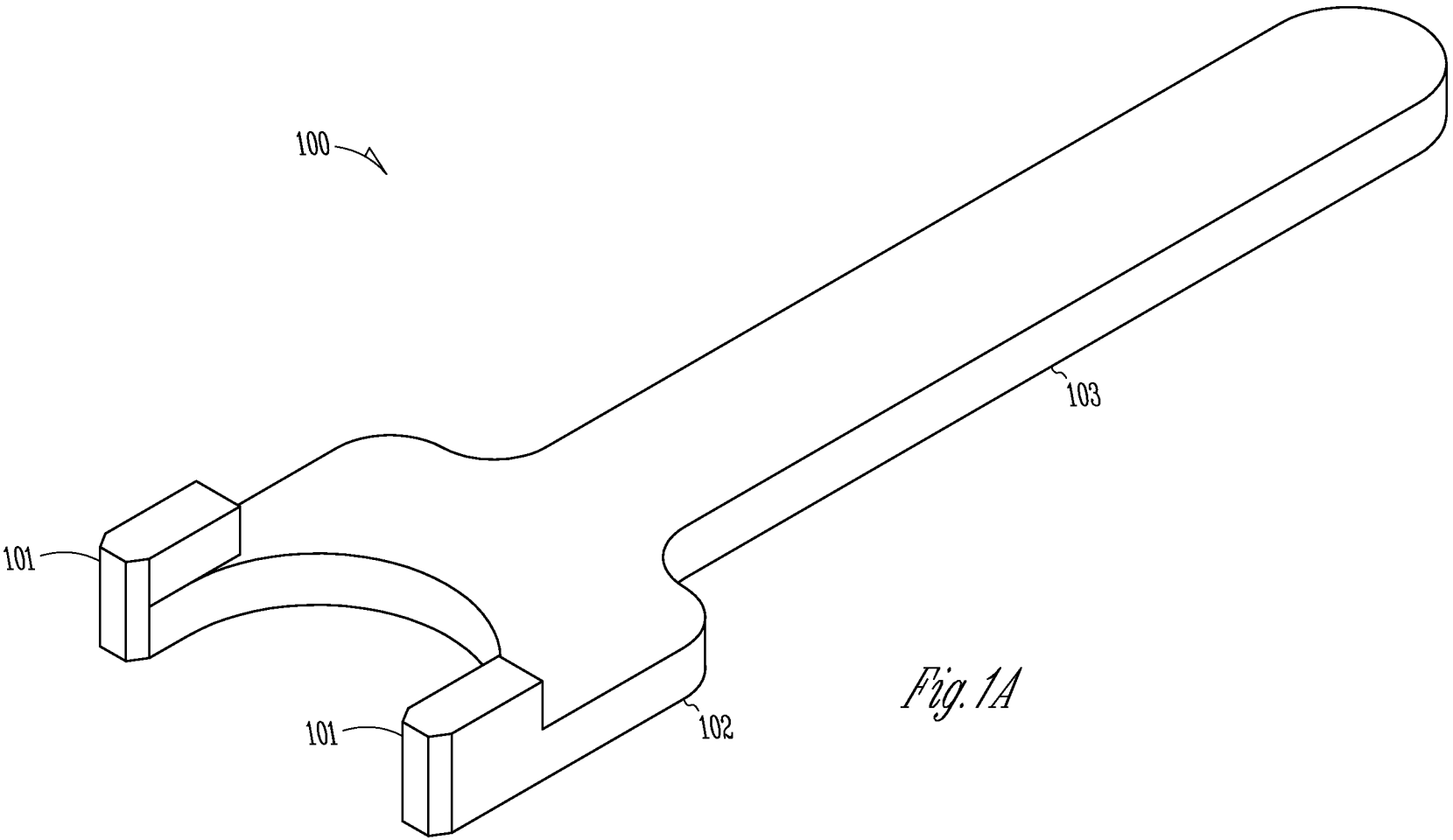
FIG. 1A is a diagram of a milling tool holder wrench, according to an example embodiment.

FIG. 1A is a diagram of a milling tool holder wrench 100, according to an example embodiment.

As used herein the phrase "milling tool holder wrench" can include wrenches customized for Cat 30, Cat 40, or Cat 50 calibrated milling machines and milling tools. In addition, the "milling tool holder wrench" can include other subsequent or different calibrated milling machines and milling tools.

The milling tool holder wrench 100 includes a pair (two) protruding knobs 101 located along a top and opened end of a u-shaped portion 102 of the milling tool holder wrench 100. Each knob 101 extends upward and perpendicular to a surface of the milling tool holder wrench 100.

The u-shaped portion 102 includes a handle portion 103 that extends from a closed end of the u-shaped portion 102.

Figure 2:
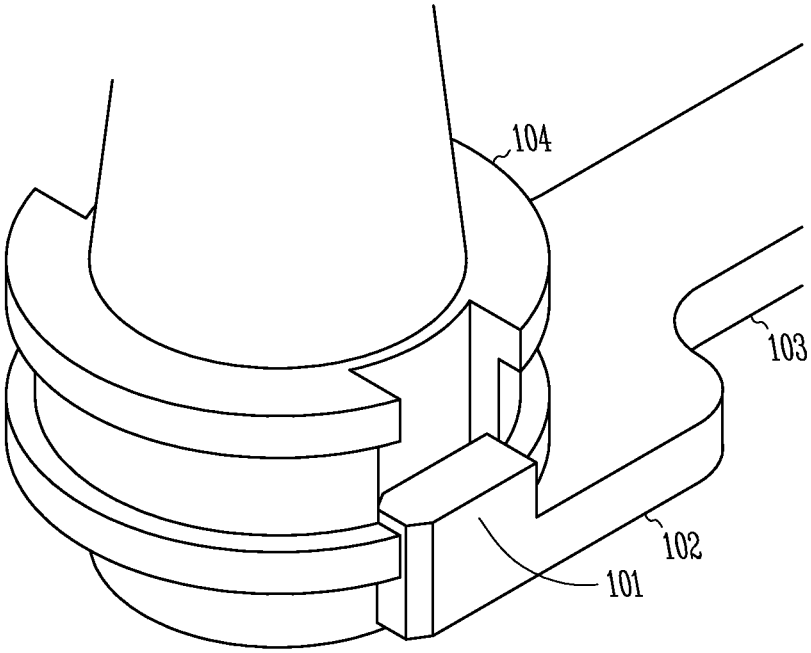
FIG. 2 is a diagram of a side view of a milling tool holder wrench engaged in a milling tool holder, according to an example embodiment.
Figure 3:
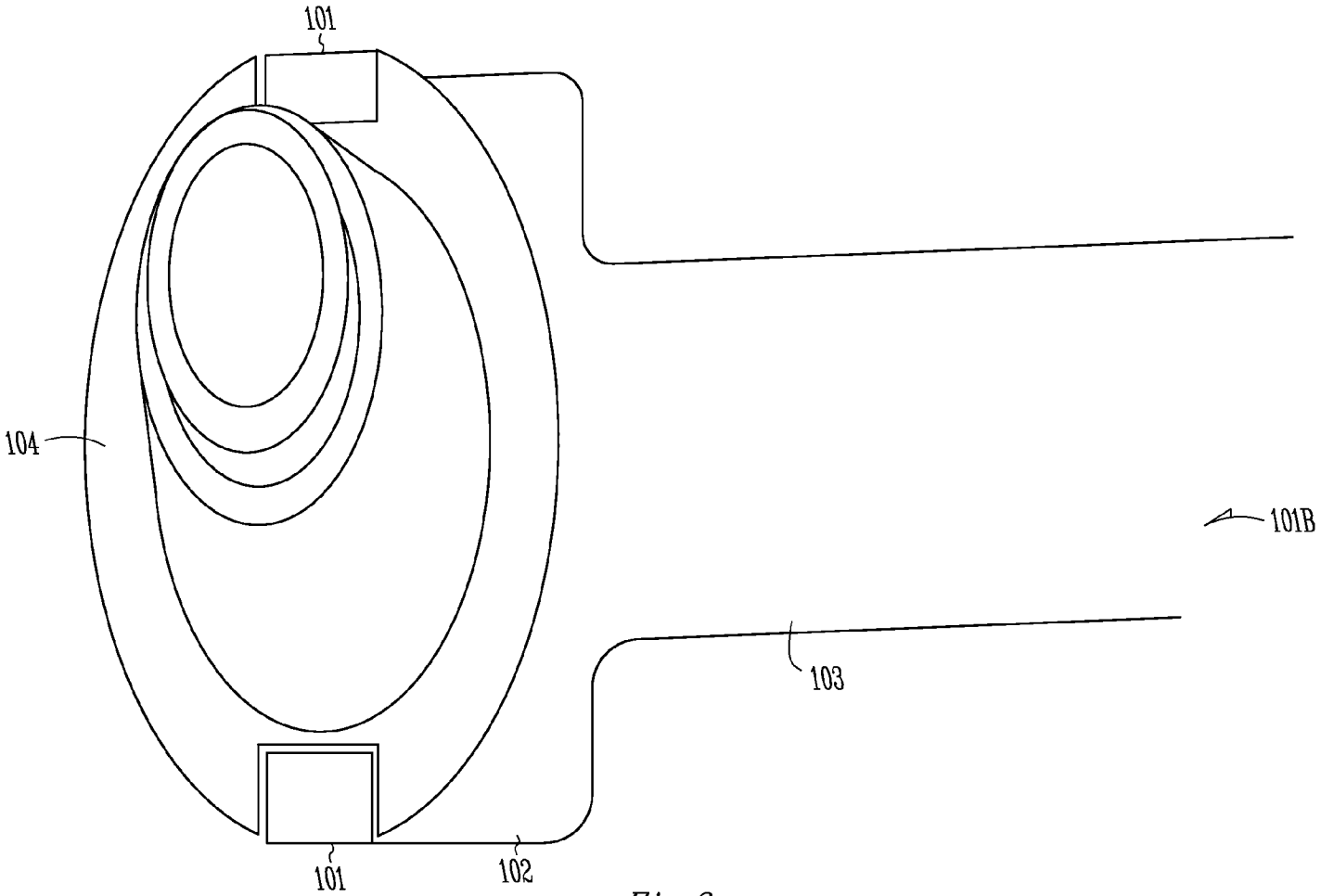
FIG. 3 is a diagram of a top-down view of a milling tool holder wrench engaged in a milling tool holder, according to an example embodiment.

Moreover, the knobs 101 are adapted to fit into a milling tool holder (104 as shown in FIGS. 2 and 3) for changing a tool out of the milling tool holder 104 while the milling tool holder 104 remains in a milling machine.

According to an embodiment, the knobs 101 are separated from one another at the top and open end of the u-shaped portion 102 by a same distance that separates two recessed fittings associated with the milling tool holder 104 (see recessed fittings as area where knobs 101 engage the milling tool holder 104 in FIGS. 2 and 3).

In another case, each knob extends outward (upward) and perpendicular from the surface of the milling tool holder wrench 100 for a minimal distance necessary to engage a recessed fitting of the milling tool holder. So, the a minimal height that will engage the recessed fittings and hold the milling tool holder 104 steady is all that is needed for each knob's height. It is noted that each knob can be molded as a variety of shapes as well and can vary from the rectangular molded knobs shown in the FIGS. 1-3.

Continuing with the prior embodiment, each knob may also include a thickness that is configurable. Again, a minimal thickness to prevent slippage of the milling tool holder 104 can be constructed.

Similarly and in an embodiment, the handle portion 103 of the milling tool holder wrench 100 can be of a configurable lengths. So, a variety of handle lengths can be constructed for the milling tool holder wrench 100.

Continuing with the prior embodiment, widths for the handle portion 103 of the milling tool holder wrench 100 can also be a constructed according to configured parameters.

The u-shaped portion 102 fits snuggly around half of an outer circumference of the milling tool holder 104.

In one situation, the milling tool holder wrench 100 is a single molded component that includes both the u-shaped portion 102 and the handle portion 103 integrated as one component, such as shown in the FIGS. 1A, 1B, 1C, 1D, and 2-3.

Continuing with the prior embodiment, the milling tool holder wrench 100 is a single molded component made or constructed from a metal or metal-based material.

In an alternative situation, the milling tool holder wrench 100 is a single molded component made or contrasted from a plastic, rubber, plastic-based, and/or rubber-based material.

In a different situation, the milling tool holder wrench 100 is constructed of two or more components that are adapted to snap/connect together to form the milling tool holder wrench 100.

For instance, the u-shaped portion 102 includes a fitting at the closed end adapted to engage socket set components and/or fittings. Here, the handle portion 103 can include a socket extender adapter component piece associated with a standard socket set that engages the closed end of the u-shaped portion 102 at one end of the extender adapter and engages a socket wrench at an opposite end of the extender adapter. In this situation where the milling tool holder wrench 100 is formed by two or more pieces that snap together, the socket extender and socket wrench can be standard components of a socket set and the u-shaped portion 102 sold as an add-on to such a set.

Figure 1B:
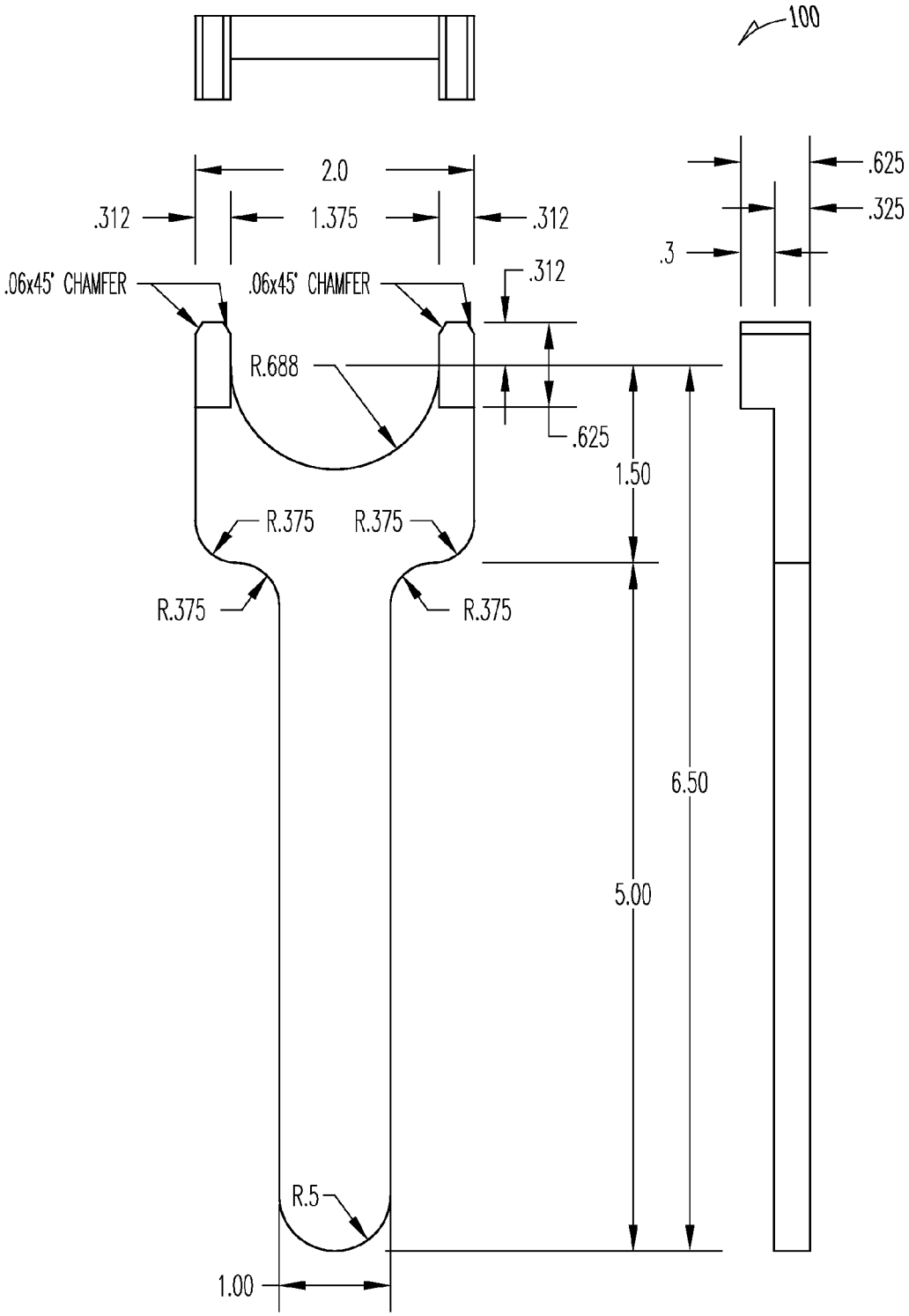
FIG. 1B is an example schematic diagram with dimensions for an example Cat 30 tool holder wrench, according to an embodiment.
Figure 1C:
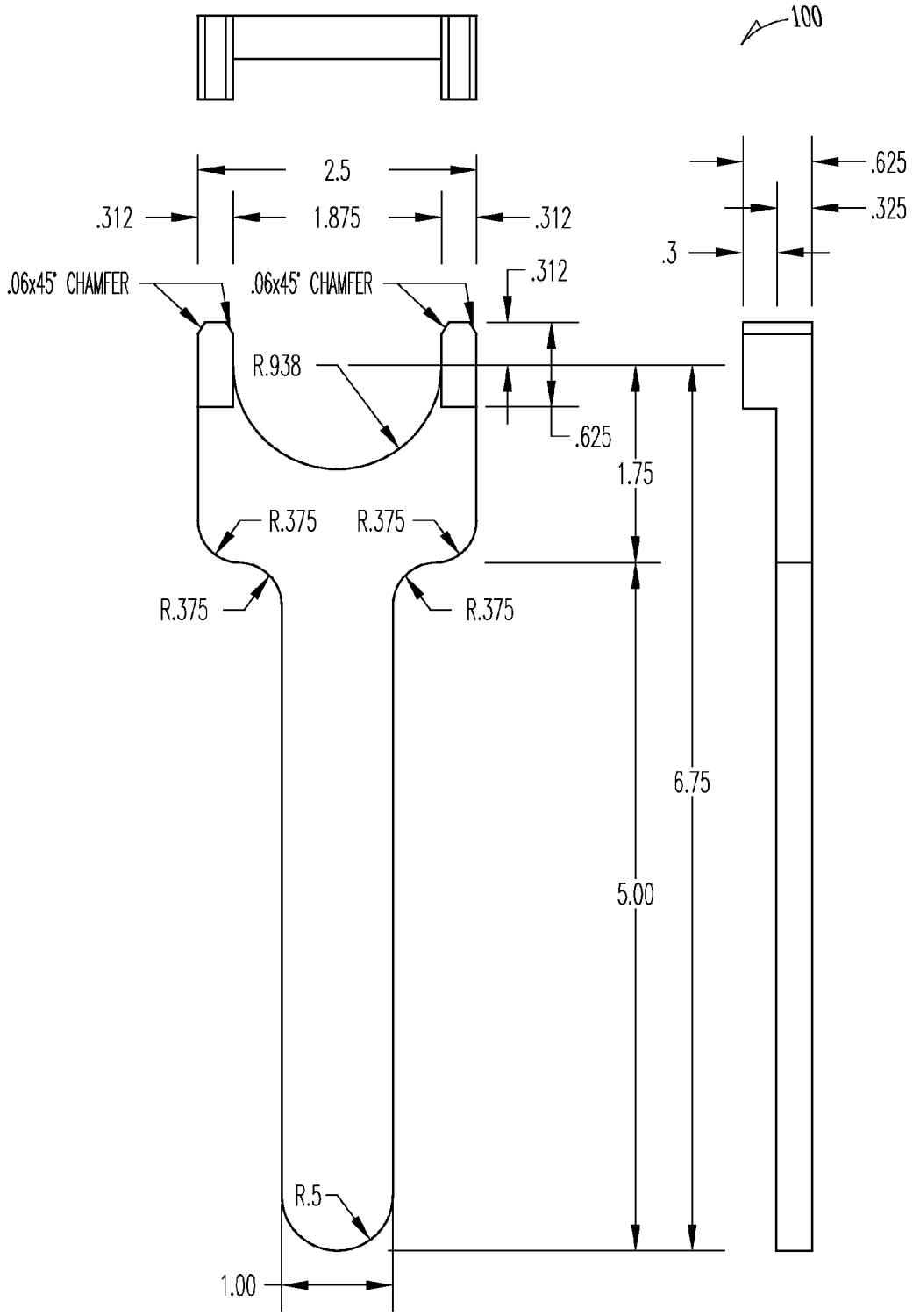
FIG. 1C is an example schematic diagram with dimensions for an example Cat 40 tool holder wrench, according to an embodiment.
Figure 1D:
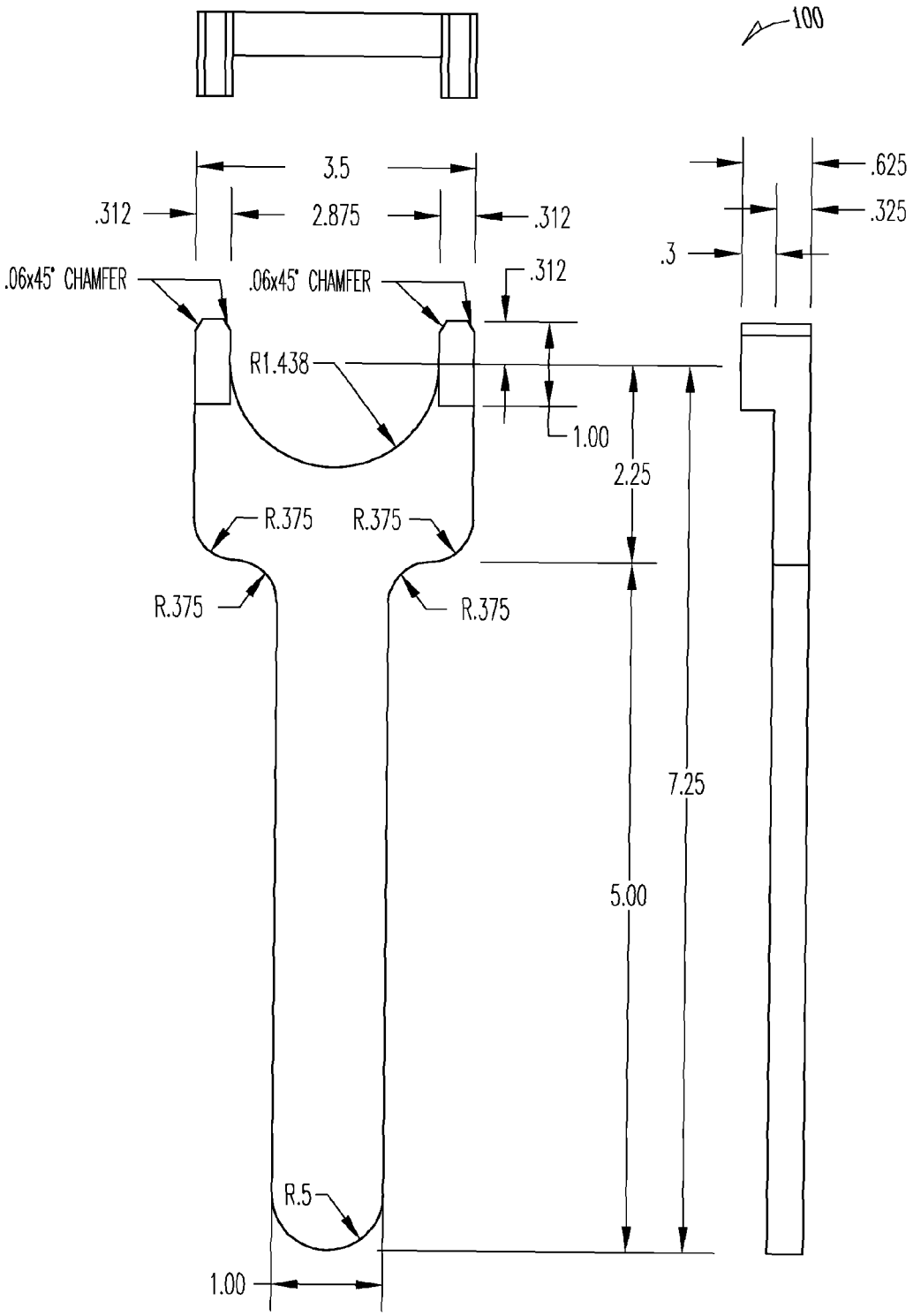
FIG. 1D is an example schematic diagram with dimensions for an example Cat 50 tool holder wrench, according to an embodiment.

Some example dimensions for the various components of an example milling tool holder wrench 100 is presented in detail in the FIG. 1B (CAT 30 tool holder wrench), 1C (CAT 40 tool holder wrench), and 1D (CAT 50 tool holder wrench).

In an embodiment, a milling tool holder changing system is presented, such as what is shown in the FIGS. 2-3. FIG. 2 is a diagram of a side view of a milling tool holder wrench 100 engaged in a milling tool holder 104, according to an example embodiment. FIG. 3 is a diagram of a top-down view of a milling tool holder wrench 100 engaged in a milling tool holder 104, according to an example embodiment.

The milling tool holding changing system includes a milling tool holder wrench 100 and a tool adapted to be inserted and removed from a milling tool holder 104. The milling tool holder wrench 100 is adapted to hold the milling tool holder 104 steady while in a milling machine and while the tool is inserted or removed from the milling tool holder 104.

According to an embodiment, the milling tool holding changing system includes the milling tool holder 104. In some cases, the milling tool holding changing system includes the milling machine as well.

Continuing with the FIG. 2, the milling tool holder wrench 100 is shown having the protruding knobs 101 engaged at a top end of a u-shaped portion 102 of the milling tool holder wrench 100 with the recessed fittings of a milling tool holder 104. This is a side view, such that one knob 101 is shown as being engaged with one recessed fitting of the milling tool holder 104.

The FIG. 3 shows a top-down view of the milling tool holder wrench 100 being engaged via the knobs 101 with the recessed fittings of the milling tool holder 104 (this shows engagement with both recessed fittings of the milling tool holder).

Figure 4:
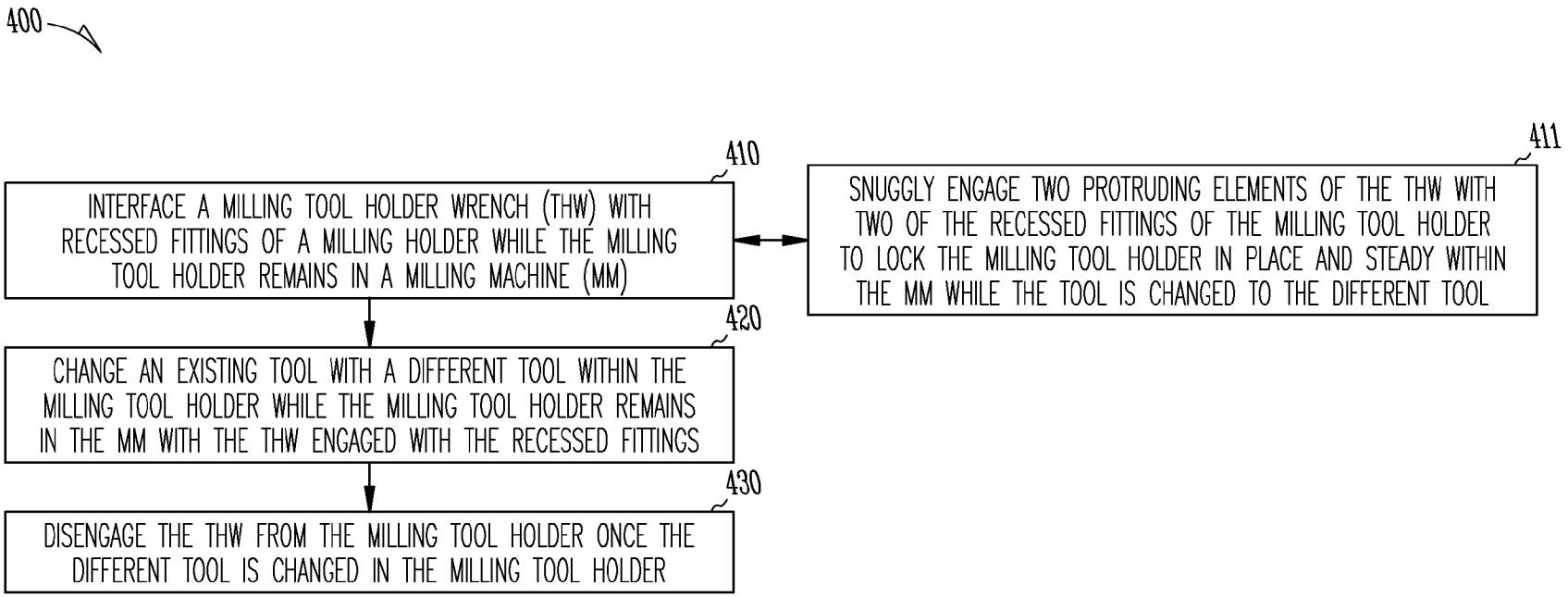
FIG. 4 is a diagram of a method for changing a milling tool out of a milling tool holder using a milling tool holder wrench, according to an example embodiment.

FIG. 4 is a diagram of a method for changing a milling tool out of a milling tool holder 104 using a milling tool holder wrench 100, according to an example embodiment. The method 400 (hereinafter "tool changing process") can be in whole or in part implemented using no machinery, some, or all machinery. That is, in some instances automated machinery may use the milling tool holder wrench 100 to remove and insert tools in a milling tool holder 104 while that milling tool holder 104 remains in a milling machine. In other cases, the tool changing process occurs via a technician or engineer that uses the milling tool holder wrench 100 on site at a milling machine facility.

At 410, the tool changing process interfaces the milling tool holder wrench 100 with recessed fittings of a milling tool holder 104 while the milling tool holder 104 remains in a milling machine. The milling tool holder wrench 100 was described in detail above with reference to the FIGS. 1A, 1B, and 2-3.

According to an embodiment, at 411, the tool changing process snuggly engages two protruding elements of the milling tool holder wrench 100 with two of the recessed fittings of the milling tool holder 104 to lock the milling tool holder 104 in place and steady within the milling machine while the tool is changed to the different tool.

At 420, the tool changing process changes out an existing tool with a different tool within the milling tool holder 104 while the milling tool holder 104 remains in the milling machine with the milling tool holder wrench 100 engaged with the recessed fittings of the milling tool holder 104.

At 430, the tool changing process disengages the milling tool holder wrench 100 from the milling tool holder 104 once the different tool is changed in the milling tool holder 104.

One of ordinary skill in the art now fully appreciates how the milling tool holder wrench 100 of the present invention permits more efficient tool changing in milling machines by permitting tool changes while the milling tool holder 104 remains in the milling machine.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

What is claimed is:

1. A milling tool holder wrench:

two protruding knobs each located along a top and opened end of a u-shaped portion of the wrench, each knob extending upward and perpendicular to a surface of the wrench, the u-shaped portion including a handle portion extending from a closed end of the u-shaped portion, and the knobs adapted to fit into a milling tool holder for changing a tool out of the milling tool holder while the milling tool holder remains in a milling machine.

2. The milling tool holder wrench of claim 1, wherein the knobs are separated from one another at the top and open end of the u-shape portion by a same distance that separates two recessed fittings associated with the milling tool holder.

3. The milling tool holder wrench of claim 1, wherein the wrench is a single molded component that includes both the u-shaped portion and the handle portion integrated as one component.

4. The milling tool holder wrench of claim 3, wherein the single molded component is constructed of a metal or metal-based material.

5. The milling tool holder wrench of claim 3, wherein the single molded component is constructed of a plastic or plastic-based material.

6. The milling tool holder wrench of claim 1, wherein each knob extends outward and perpendicular from the surface for a minimal distance necessary to engage a recessed fitting of the milling tool holder.

7. The milling tool holder wrench of claim 1, wherein a thickness for each knob is configurable.

8. The milling tool holder wrench of claim 1, wherein a length of the handle portion is configurable.

9. The milling tool holder wrench of claim 1, wherein dimensions of the milling tool holder wrench are configured for one of a cat 30 milling tool, a cat 40 milling tool, and a cat 50 milling tool.

10. A system, comprising:

a milling tool holder wrench; and a tool adapted to be inserted and removed from a milling tool holder;

wherein the milling tool holder wrench is adapted to hold the milling tool holder steady while in a milling machine and while the tool is inserted or removed from the milling tool holder.

11. The system of claim 10 further comprising, the milling tool holder.

12. The system of claim 10, wherein the milling tool holder wrench includes an engaging mechanism at each end of a u-shaped portion of the milling tool holder wrench that locks into recessed fittings of the milling tool holder.

13. The system of claim 12, wherein the u-shaped portion fits snuggly around half of an outer circumference of the milling tool holder.

14. The system of claim 13, wherein the milling tool holder wrench includes a handle portion extending from a closed end of the u-shaped portion.

15. The system of claim 14, wherein the u-shaped portion and the handle portion are integrated as one molded piece to form the milling tool holder wrench.

16. The system of claim 14, wherein the u-shaped portion and the handle portion are two separate components that adaptably connect to form the milling tool holder wrench.

17. The system of claim 16, wherein the u-shaped portion includes a fitting at the closed end adapted to engage socket set components.

18. The system of claim 17, wherein the handle portion includes an extender component piece of a socket set that engages the closed end of the u-shaped portion at one of the extender component piece and a socket wrench at an opposite end of the extender component piece.

19. A method, comprising:

interfacing a milling tool holder wrench with recessed fittings of a milling tool holder while the milling tool holder remains in a milling machine;

changing an existing tool with a different tool within the milling tool holder while the milling tool holder remains in the milling machine with the milling tool holder wrench engaged with the recessed fittings; and disengaging the milling tool holder wrench from the milling tool holder once the different tool is changed in the milling tool holder.

20. The method of claim 19, wherein interfacing further includes snuggly engaging two protruding elements of the milling tool holder wrench with two of the recessed fittings of the milling tool holder to lock the milling tool holder in place and steady within the milling machine while the tool is changed to the different tool.

* * * * *